US012729924B1

(12) United States Patent
Schaden et al.

(10) Patent No.: US 12,729,924 B1
(45) Date of Patent: Sep. 8, 2026

(54) COMPENSATORS AND COMPENSATOR SYSTEMS FOR FIREARMS

(71) Applicant: Vantage Point Archery, LLC, Fort Wayne, IN (US)

(72) Inventors: Jeff Schaden, Bluffton, IN (US); Darrel Ray Barnette, Austin, TX (US)

(73) Assignee: Vantage Point Archery, LLC, Fort Wayne, IN (US)

( * ) Notice: Subject to any disclaimer, the term of this patent is extended or adjusted under 35 U.S.C. 154(b) by 0 days.

(21) Appl. No.: 18/933,576

(22) Filed: Oct. 31, 2024

Related U.S. Application Data

(60) Provisional application No. 63/546,903, filed on Nov. 1, 2023.

(51) Int. Cl.
*F41A 21/36* (2006.01)

(52) U.S. Cl.
CPC ..... *F41A 21/36* (2013.01)

(58) Field of Classification Search
CPC ..... F41A 21/00; F41A 21/32; F41A 21/325; F41A 21/30; F41A 21/36
See application file for complete search history.

(56) References Cited

U.S. PATENT DOCUMENTS 4,479,418 A * 10/1984 Beretta ..... F41A 21/30 89/14.4
6,223,458 B1 * 5/2001 Schwinkendorf ..... F41A 21/487 42/1.06
7,194,836 B1 * 3/2007 Urban ..... F41C 27/22 89/14.05
7,578,090 B1 * 8/2009 Romaszka ..... F41G 11/003 42/96
D687,508 S * 8/2013 Peterman ..... D22/108
9,488,437 B1 * 11/2016 Schnog ..... F41J 5/10
9,939,224 B2 * 4/2018 Fischer ..... F41A 21/30
10,161,704 B1 * 12/2018 Lee ..... F41A 21/325
10,254,085 B2 * 4/2019 Willmann ..... F41A 21/325
10,890,400 B2 * 1/2021 Christandl ..... F41A 21/325
2009/0193963 A1 * 8/2009 Poulsen ..... F41A 21/30 89/14.4
2015/0362276 A1 * 12/2015 Fischer ..... F41A 21/30 89/14.4
2017/0370679 A1 * 12/2017 Willmann ..... F41G 11/004
2018/0292161 A1 * 10/2018 Christandl ..... F41A 21/30
(Continued)

FOREIGN PATENT DOCUMENTS

IT 1194990 B * 9/1988 ..... F41A 21/30
WO WO-2014127831 A1 * 8/2014 ..... F41A 21/30
WO WO-2017102132 A1 * 6/2017 ..... F41A 21/30

*Primary Examiner* — Benjamin P Lee
(74) *Attorney, Agent, or Firm* — Faegre Drinker Biddle & Reath LLP

(57) ABSTRACT

A compensator is configured to couple an accessory to a firearm, and the compensator includes a muzzle portion and a mounting portion. The muzzle portion is configured to be positioned adjacent a muzzle of the firearm, and the muzzle portion configured to redirect propellant gasses escaping from the muzzle of the firearm to reduce recoiling motion of the firearm. The mounting portion is coupled to the muzzle portion. The mounting portion is configured to detachably couple to an accessory rail of the firearm, and the mounting portion is configured to detachably receive a fastener to detachably couple to the accessory.

20 Claims, 15 Drawing Sheets

(56) References Cited

U.S. PATENT DOCUMENTS

| | | | | |
|---|---|---|---|---|
| 2019/0101350 | A1* | 4/2019 | Hall | F41A 21/325 |
| 2025/0075994 | A1* | 3/2025 | Askerlund | F41A 21/36 |
| 2025/0237456 | A1* | 7/2025 | Fischer | F41A 21/30 |

* cited by examiner

COMPENSATORS AND COMPENSATOR SYSTEMS FOR FIREARMS

CROSS-REFERENCE TO RELATED APPLICATION

The present application claims the benefit of and priority to, under 35 U.S.C. § 119(e), U.S. Provisional Application Ser. No. 63/546,903, filed Nov. 1, 2023, entitled ACCESSORY-BEARING PISTOL COMPENSATOR AND SUPPRESSOR MOUNT ASSEMBLY, which is hereby incorporated by reference in its entirety for all purposes.

BACKGROUND

A compensator is a device mounted near the muzzle of a firearm that reduces the severity of recoiling motion that occurs when the firearm is discharged. A compensator achieves this by venting propellant gasses escaping from the muzzle in a direction different than that of the recoiling motion of the firearm. In some instances, compensators may be threadably attached directly to the muzzle end of the barrel, or they may be mounted directly to an accessory rail on the frame of the firearm. In some previous frame-mounted compensators, the compensator body itself accommodates further accessories (such as a light or laser). The arrangement of having the compensator attached to the accessory rail, and subsequently having the accessory mount to the compensator, creates an unfavorable arrangement that requires a non-standard custom holster to safely carry the firearm/compensator/accessory combination.

SUMMARY

Some embodiments of the present disclosure relate to a one-piece frame-mounted pistol compensator that fits on a semi-automatic pistol with an accessory rail. In order for the compensator to be fixed to the pistol, components of a pre-existing accessory such as a light or laser, may provide an attachment means. The accessory has its original attachment rails unbolted and removed. Then, attachment of the accessory to the compensator's integral mounting fork is performed using small threaded bolts. In function, the compensator mounting fork replaces the accessory's original attachment rails such that the attachment hardware of the accessory itself is used to "lock" the combined compensator and accessory onto to the frame of the pistol.

Some embodiments of the present disclosure include one or more of the following benefits:

(1) Unlike previous frame-mounted compensators, compensators according to some embodiments of the present disclosure integrate the accessory into how it attaches to the pistol. One associated advantage is holster selection. More specifically, any universal holster or custom holster that normally accepts a standard frame-mounted accessory, such as a light or laser, will fit with no modifications to the holster because the accessory remains in the same location as when mounted using the original rails of the accessory.

(2) Compensators according to some embodiments of the present disclosure can be used as a "standoff device" because the compensator extends forward ahead of the muzzle of the barrel. That is, when in a situation where the muzzle of the firearm is pushed up against its intended target, the pistol will not go out of battery and therefore it will still be able to fire with the compensator in place. Means of achieving standoff when an accessory, such as a torch, is mounted typically includes having the accessory physically extend past the end of the barrel or past the end of a barrel-mounted compensator.

(3) Typical barrel-mounted compensators are disassembled and unthreaded to be cleaned, which can be a hassle and time consuming. In contrast, compensators according to some embodiments of the present disclosure may be unclamped from the rail by disengaging the locking lug on the accessory for easy field stripping and cleaning of the firearm.

(4) According to some embodiments of the present disclosure, during firing of the firearm, the attached compensator funnels the gas from the propellant through a convergent cone coaxially machined into the compensator that aligns with the barrel centerline and up through vents at the top of the compensator. This further reduces felt recoil. Also, because compensators according to some embodiments of the present disclosure do not attach to the reciprocating slide or barrel, such compensators do not inhibit, change, or impede the cycling action of the firearm.

Compensators according to some embodiments of the present disclosure include means to attach a suppressor for semi-automatic firearms, such as pistols, that utilize a rotating barrel system to lock the recoiling parts of the firearm together during the firing sequence and therefore cannot otherwise accept a barrel mounted suppressor. This contrasts with the more common tilt barrel pistol designs which easily allow for a barrel mounted suppressor to be threadably attached.

In one Example ("Example 1"), a compensator is configured to couple an accessory to a firearm, and the compensator includes: a muzzle portion configured to be positioned adjacent a muzzle of the firearm, the muzzle portion configured to redirect propellant gasses escaping from the muzzle of the firearm to reduce recoiling motion of the firearm; and a mounting portion coupled to the muzzle portion, the mounting portion being configured to detachably couple to an accessory rail of the firearm, and the mounting portion being configured to detachably receive a fastener to detachably couple to the accessory.

In another Example ("Example 2"), the compensator of Example 1, wherein the mounting portion includes a slot configured to receive a securing bar of the accessory.

In another Example ("Example 3"), the compensator of Example 1, wherein the mounting portion includes a first arm and a second arm that are configured to receive therebetween the accessory rail of the firearm.

In another Example ("Example 4"), the compensator of Example 1, wherein the muzzle portion and the mounting portion are monolithically formed with each other.

In another Example ("Example 5"), the compensator of Example 1, wherein the muzzle portion includes a bore.

In another Example ("Example 6"), the compensator of Example 5, wherein the bore is a tapering bore.

In another Example ("Example 7"), the compensator of Example 6, wherein the bore tapers inwardly proceeding away from the mounting portion.

In another Example ("Example 8"), the compensator of Example 5, wherein the muzzle portion includes a gas port coupled to the bore.

In another Example ("Example 9"), a compensator system is configured to couple to a firearm, and the compensator system includes: a compensator, including: a muzzle portion configured to be positioned adjacent a muzzle of the firearm; a mounting portion coupled to the muzzle portion, the mounting portion being configured to detachably couple to an accessory rail of the firearm, and the mounting portion including a through aperture; a mounting bracket configured to be received in a mounting slot of the firearm, the mounting bracket including an aperture; and a fastener received in the through aperture of the mounting portion and the aperture of the mounting bracket to secure the compensator to the firearm.

In another Example ("Example 10"), the compensator system of Example 9, wherein the mounting portion further includes a first arm and a second arm that are configured to receive therebetween the accessory rail of the firearm.

In another Example ("Example 11"), the compensator system of Example 10, wherein the mounting portion further includes a platform disposed between the first arm and the second arm, the platform including the through aperture.

In another Example ("Example 12"), the compensator system of Example 9, wherein the muzzle portion and the mounting portion are monolithically formed with each other.

In another Example ("Example 13"), the compensator system of Example 9, wherein the muzzle portion includes a bore.

In another Example ("Example 14"), the compensator system of Example 13, wherein the bore is a tapering bore.

In another Example ("Example 15"), the compensator system of Example 14, wherein the bore tapers inwardly proceeding away from the mounting portion.

In another Example ("Example 16"), the compensator system of Example 13, wherein the muzzle portion includes a gas port coupled to the bore.

In another Example ("Example 17"), the compensator system of Example 9, wherein the fastener is a threaded fastener and the aperture of the mounting bracket is a threaded aperture.

In another Example ("Example 18"), the compensator system of Example 9, wherein the aperture of the mounting bracket is a blind aperture.

In another Example ("Example 19"), a firearm system including: a firearm including a muzzle having an accessory rail; an accessory; a fastener; a compensator including: a muzzle portion configured to be positioned adjacent the muzzle of the firearm, the muzzle portion configured to redirect propellant gasses escaping from the muzzle of the firearm to reduce recoiling motion of the firearm; and a mounting portion coupled to the muzzle portion, the mounting portion being configured to detachably couple to the accessory rail of the firearm, and the mounting portion being configured to detachably receive the fastener to detachably couple to the accessory.

In another Example ("Example 20"), the firearm system of Example 19, wherein the mounting portion includes a slot configured to receive a securing bar of the accessory.

In another Example ("Example 21"), the firearm system of Example 19, wherein the mounting portion includes a first arm and a second arm that are configured to receive therebetween the accessory rail of the firearm.

In another Example ("Example 22"), the firearm system of Example 19, wherein the muzzle portion and the mounting portion are monolithically formed with each other.

In another Example ("Example 23"), the firearm system of Example 19, wherein the muzzle portion includes a bore.

In another Example ("Example 24"), the firearm system of Example 23, wherein the bore is a tapering bore.

In another Example ("Example 25"), the firearm system of Example 24, wherein the bore tapers inwardly proceeding away from the mounting portion.

In another Example ("Example 26"), the firearm system of Example 23, wherein the muzzle portion includes a gas port coupled to the bore.

BRIEF DESCRIPTION OF THE DRAWINGS

The above mentioned and other features of the disclosure, and the manner of attaining them, will become more apparent and the disclosure itself will be better understood by reference to the following description of embodiments of the disclosure taken in conjunction with the accompanying drawings.

The examples set out herein illustrates an embodiment of the disclosure, and such examples are not to be construed as limiting the scope of the disclosure in any manner.

DETAILED DESCRIPTION OF THE DRAWINGS

Figure 1:
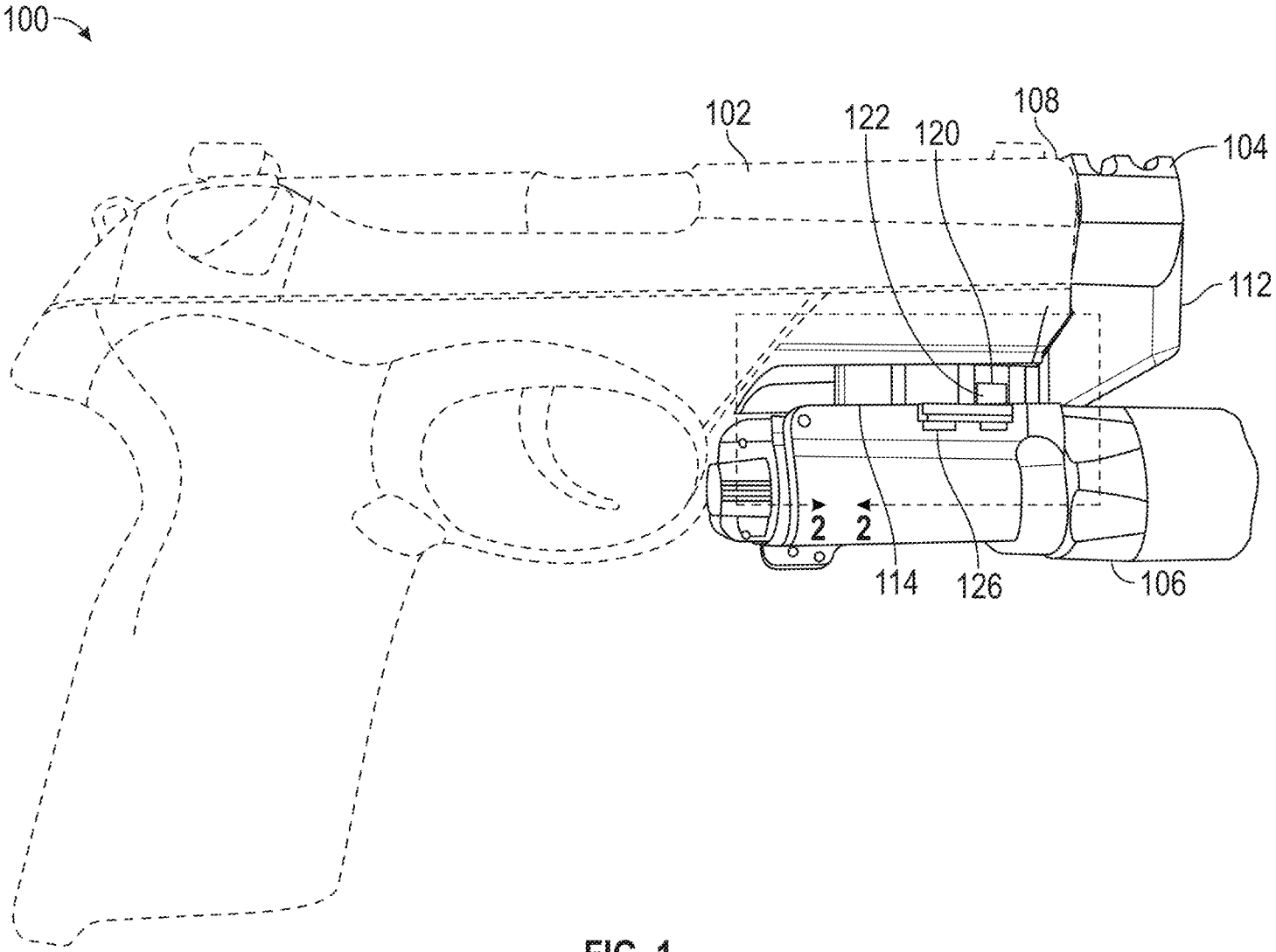
FIG. 1 is a side view of a firearm system, according to an embodiment of the present disclosure.
Figure 2:
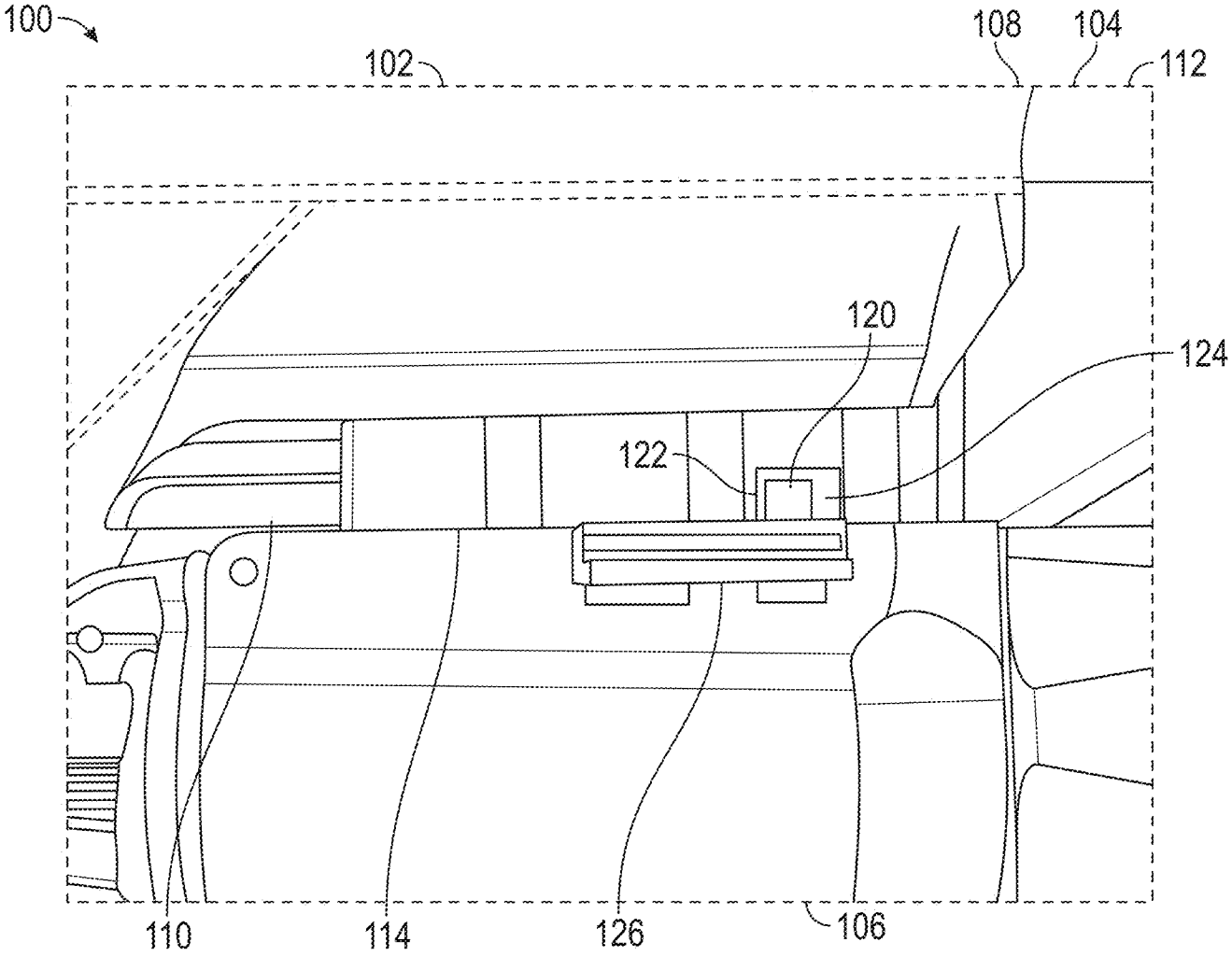
FIG. 2 is a side detail view of the firearm system within line 2-2 of FIG. 1.
Figure 3:
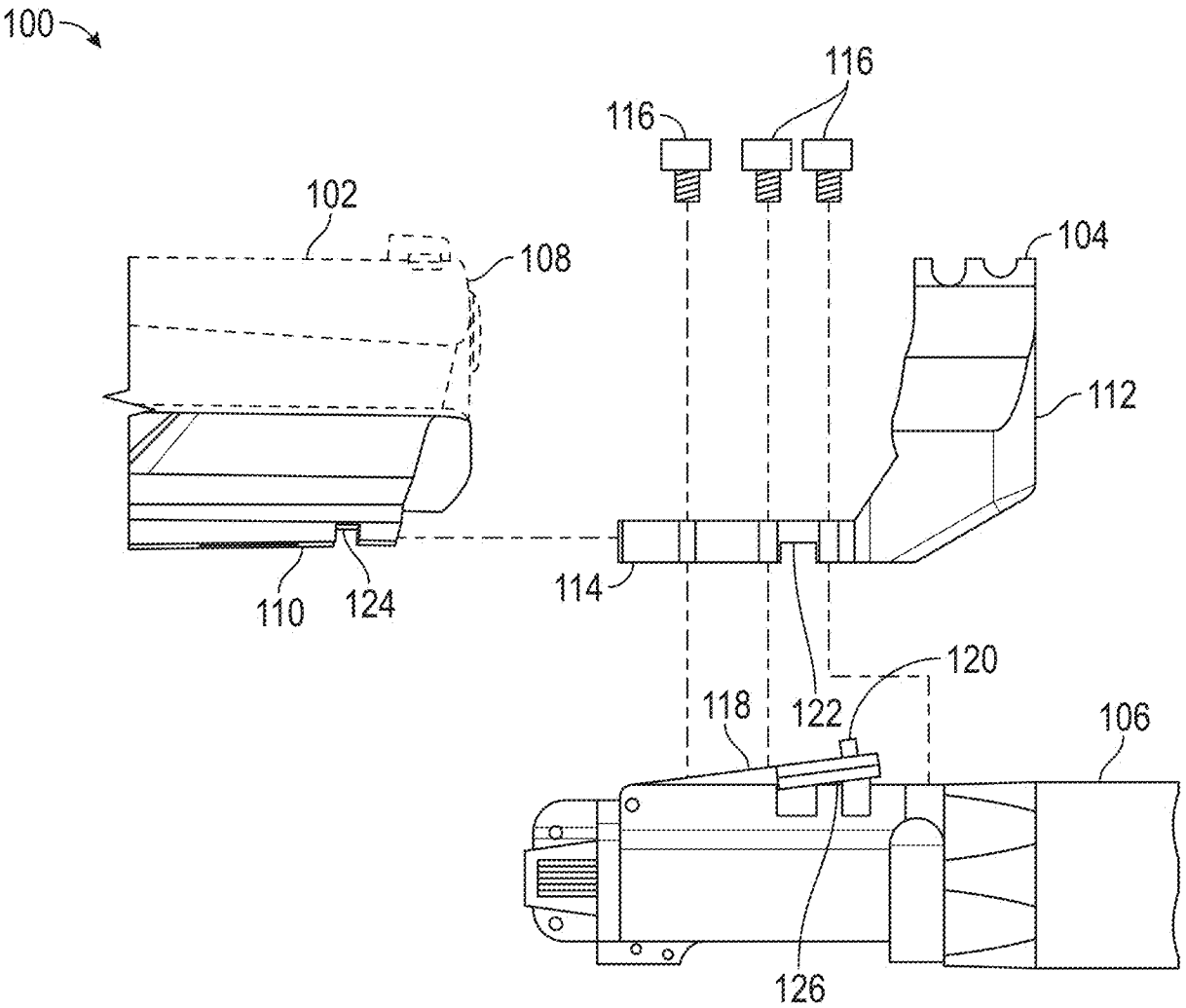
FIG. 3 is an exploded side view of the firearm system of FIG. 1.

FIGS. 1-3 illustrate a firearm system 100 according to an embodiment of the present disclosure. More specifically, FIG. 1 is a side view of the firearm system 100, FIG. 2 is a detail side view illustrating an interface between a firearm 102, a compensator 104, and an accessory 106 of the system 100, and FIG. 3 is an exploded side view of the firearm 102, the compensator 104, and the accessory 106 of the system 100.

The firearm 102 may be, for example, a pistol, more specifically a semi-automatic pistol. In other embodiments, the firearm 102 is a different type of firearm. The firearm 102 includes a muzzle 108 having accessory rails 110 (FIGS. 2 and 3) that facilitates mounting the compensator 104 and the accessory 106.

With continued reference to FIGS. 1-3, the compensator 104 generally includes a muzzle portion 112 that is coupled to a mounting portion 114, which may also be referred to as a mounting fork. The muzzle portion 112 is configured to be positioned in front on the muzzle 108 of the firearm 102 when the compensator 104 is mounted to the firearm 102. As described in further detail below, the muzzle portion 112 is configured to redirect propellant gasses escaping from the muzzle 108 of the firearm 102 in a manner that reduces recoiling motion of the firearm 102. The mounting portion 114 of the compensator 104 is configured to detachably couple to both the firearm 102, via the accessory rails 110, and the accessory 106, via one or more fasteners 116 (FIG. 3), such as threaded fasteners. Accordingly, the mounting portion 114 of the compensator 104 is configured to detachably couple the firearm 102 and the accessory 106 to each other.

The accessory 106 may be, for example, a light or torch. In other embodiments, the accessory 106 is a different type of firearm-mounted accessory. The accessory 106 includes a spring-biased mounting plate 118 (FIG. 3) that carries a securing bar 120. The securing bar 120 is biased toward and received in a mounting slot 122 of the mounting portion 114 of the compensator 104 and a mounting slot 124 (FIGS. 2 and 3) of the accessory rails 110 of the firearm 102, and the securing bar 120 thereby secures the accessory 106 and the compensator 104 to the firearm 102. The mounting plate 118 further carries one or more release tabs 126 that facilitate moving the securing bar 120 apart from the slots 122, 124 and thereby detaching the accessory 106 and the compensator 104 from the firearm 102.

Figure 4:
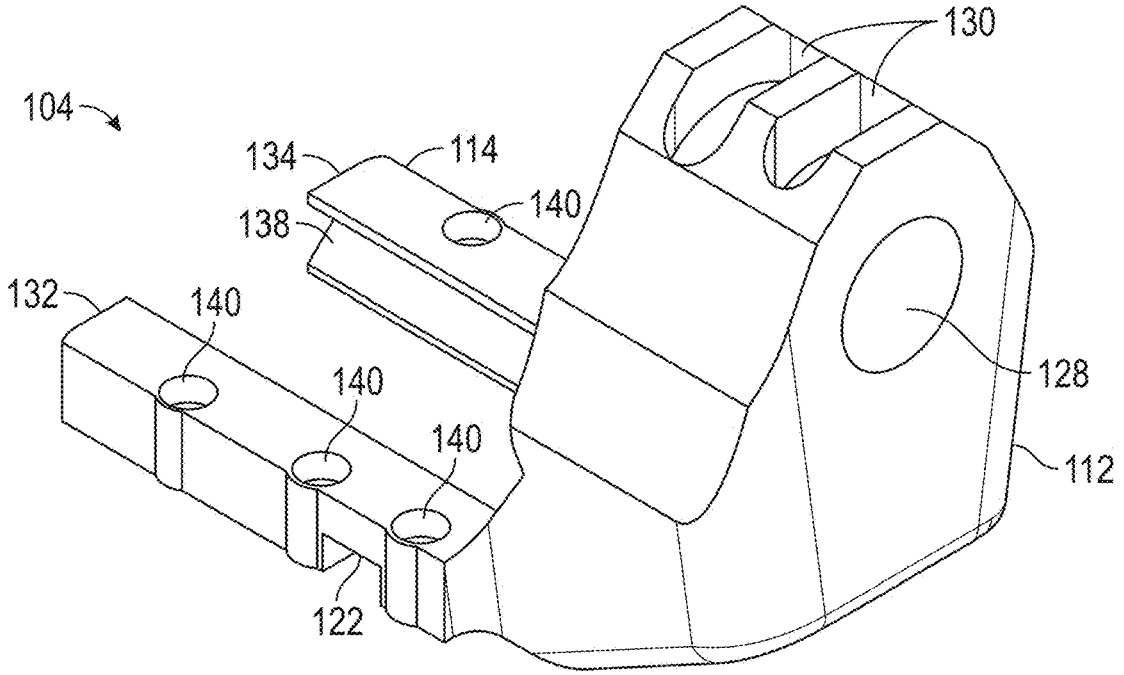
FIG. 4 is a front perspective view of a compensator of the firearm system of FIG. 1.
Figure 5:
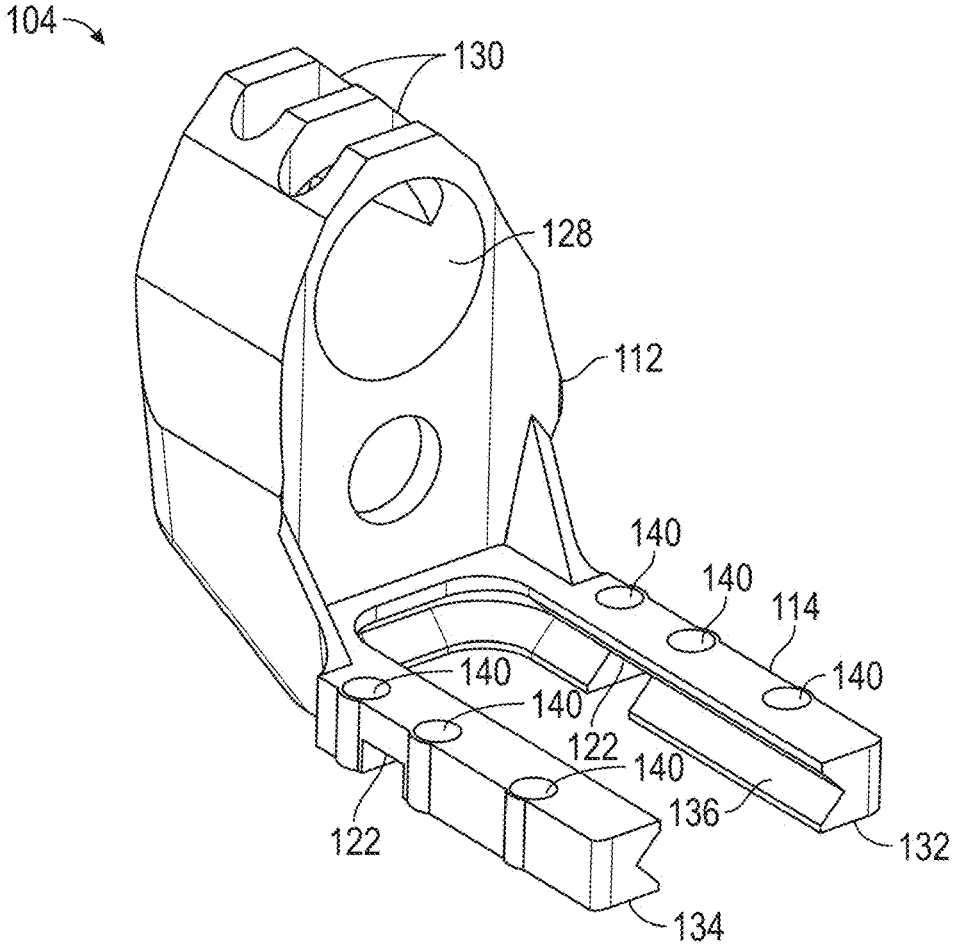
FIG. 5 is a rear perspective view of the compensator of FIG. 4.
Figure 6:
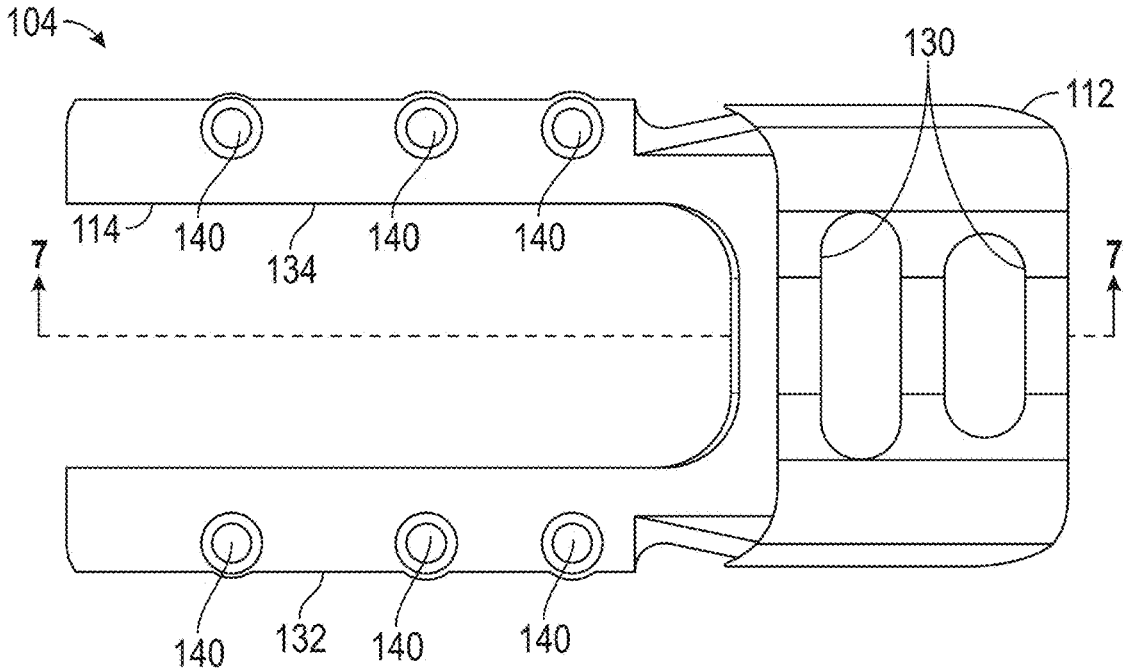
FIG. 6 is a top view of the compensator of FIG. 4.
Figure 7:
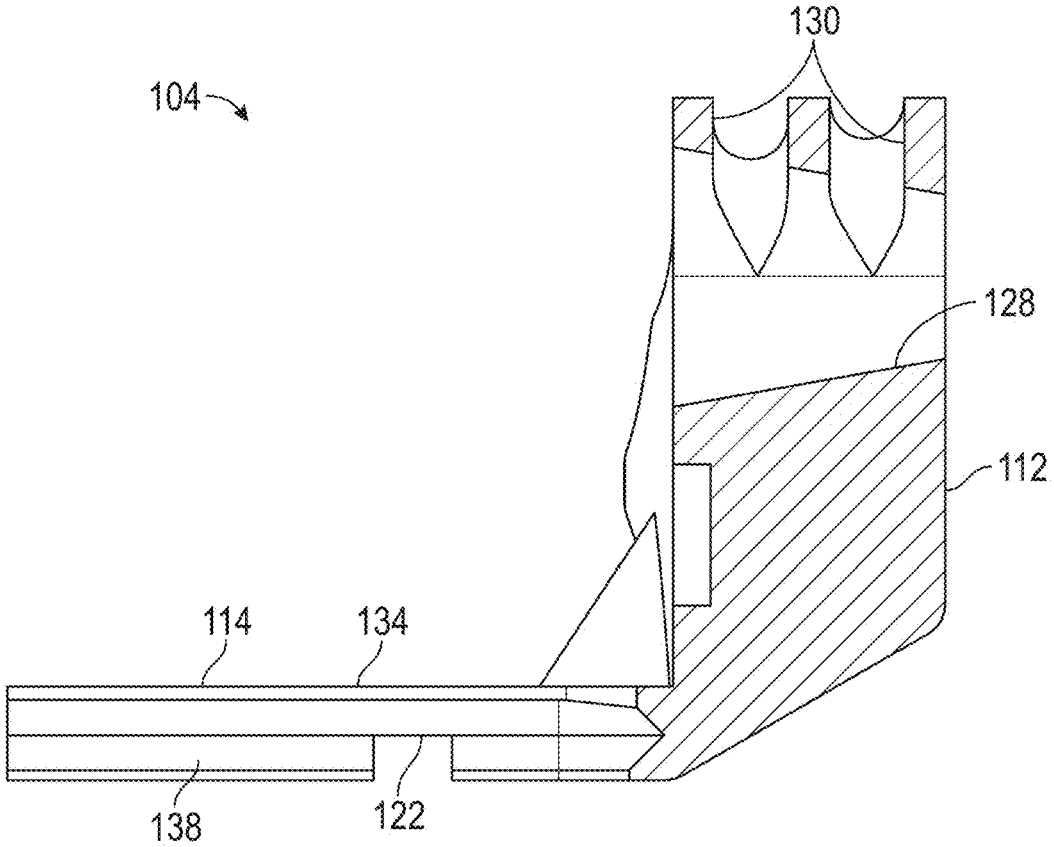
FIG. 7 is a side section view of the compensator along line 7-7 of FIG. 6.

FIGS. 4-7 illustrate the compensator 104 in further detail. More specifically, FIGS. 4 and 5 are perspective views of the compensator 104, FIG. 6 is a top view of the compensator 104, and FIG. 7 is a side section view of the compensator 104 along line 7-7 of FIG. 6. As illustrated, the muzzle portion 112 and the mounting portion 114 of the compensator 104 may be monolithically formed with each other or constructed from a single piece of material. In other embodiments, the muzzle portion 112 and the mounting portion 114 may be constructed from separate pieces of material and coupled to each other. The compensator 104 may be constructed of various appropriate materials, including metals, plastics, composites, or the like.

The muzzle portion 112 of the compensator 104 includes a bore 128 that illustratively tapers inwardly in the direction of bullet travel or proceeding away from the muzzle 108 of the firearm 102 (shown elsewhere) and the mounting portion 114. In some embodiments, the bore 128 may taper at an angle in a range of about 30 degrees to about 10 degrees, more specifically at an angle in a range of about 20 degrees. The taper of the bore 128 facilitates generating relatively high pressure (i.e., compared to a bore lacking a taper) at one or more gas ports 130 coupled to the bore 128, which extend generally perpendicularly relative to the direction of bullet travel. The tapered bore 128 thereby facilitates relatively high gas exit velocity, which reduces muzzle flip of the firearm 102 as a bullet exits the muzzle 108 and the firearm 102 begins to recoil.

With continued reference to FIGS. 4-7, the mounting portion 114 includes a first arm 132 and a second arm 134 that are configured to receive therebetween and slide along the accessory rails 110 of the firearm 102 (shown elsewhere). Illustratively, the first arm 132 and the second arm 134 include inverted V-shaped internal surfaces 136 and 138, respectively, that are configured to contact V-shaped external surfaces of the accessory rails 110 of the firearm 102. The first arm 132 and the second arm 134 include through apertures 140, more specifically threaded apertures, for receiving the fasteners 116 (shown elsewhere) and thereby coupling the compensator 104 to the accessory 106.

Figure 8:
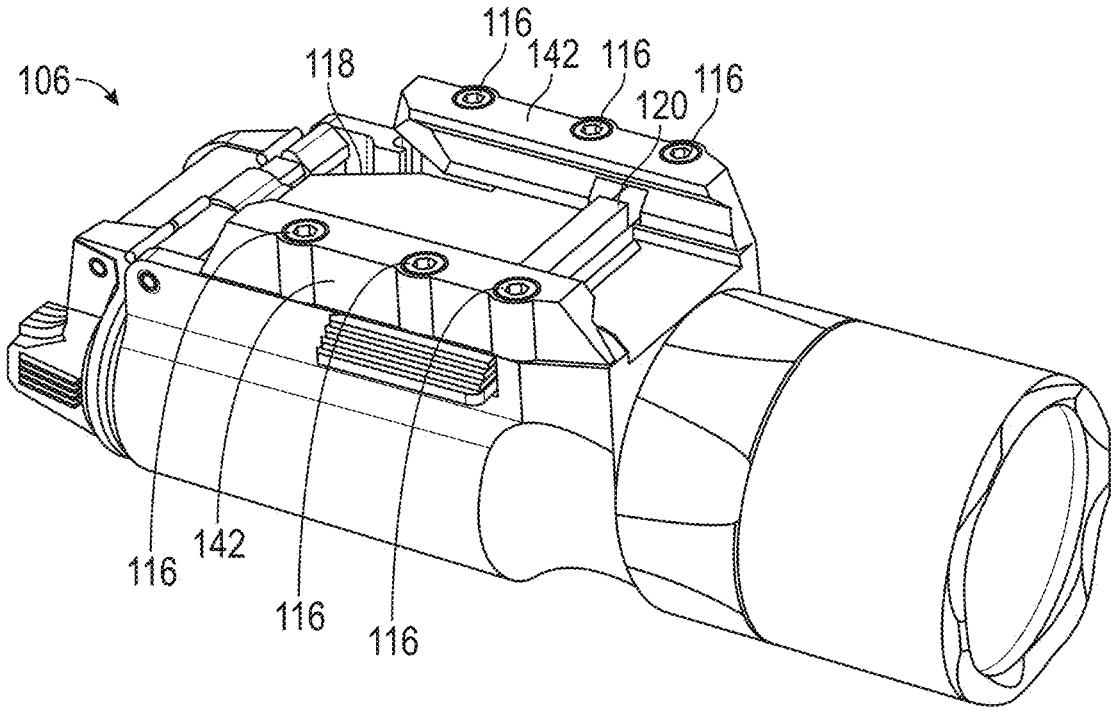
FIG. 8 is a front perspective view of an accessory of the firearm system of FIG. 1, prior to detachment of an accessory rail.
Figure 9:
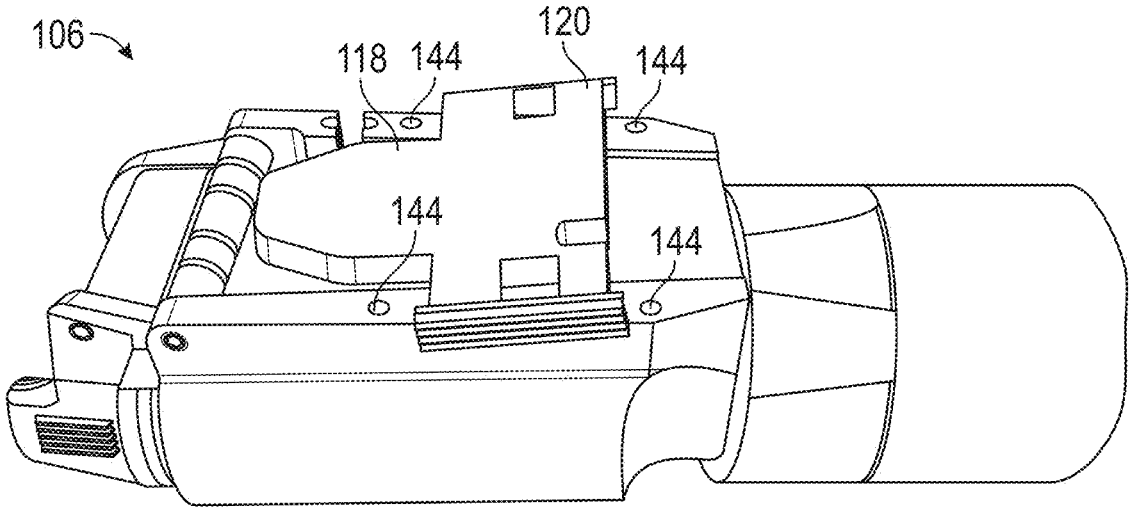
FIG. 9 is a side perspective view of the accessory of FIG. 8, after detachment of the accessory rail.

FIGS. 8 and 9 illustrate the accessory 106 in further detail. More specifically, FIG. 8 is a perspective view of the accessory 106 with two factory-supplied removable attachment rails 142 that are secured via the fasteners 116. The attachment rails 142 initially overlie the mounting plate 118 and the securing bar 120. In other systems, the accessory 106 would be attached to the accessory rails 110 of the firearm 102 (shown elsewhere) via the attachment rails 142. FIG. 9 is a perspective view of the accessory 106 with the attachment rails 142 removed and the fasteners 116 separated from blind apertures 144, more specifically threaded blind apertures. With the attachment rails 142 removed, the accessory 106 is configured to be coupled to the mounting portion 114 of the compensator 104 via the fasteners 116 (shown elsewhere—i.e., the fasteners 116 initially coupling the attachment rails 142 to the accessory 106 may be reused to couple the compensator 104 and the accessory 106 to the firearm 102).

Advantageously, the firearm system 100 may be inserted in a holster designed to receive a firearm carrying an accessory but not necessarily carrying a compensator.

Figure 10:
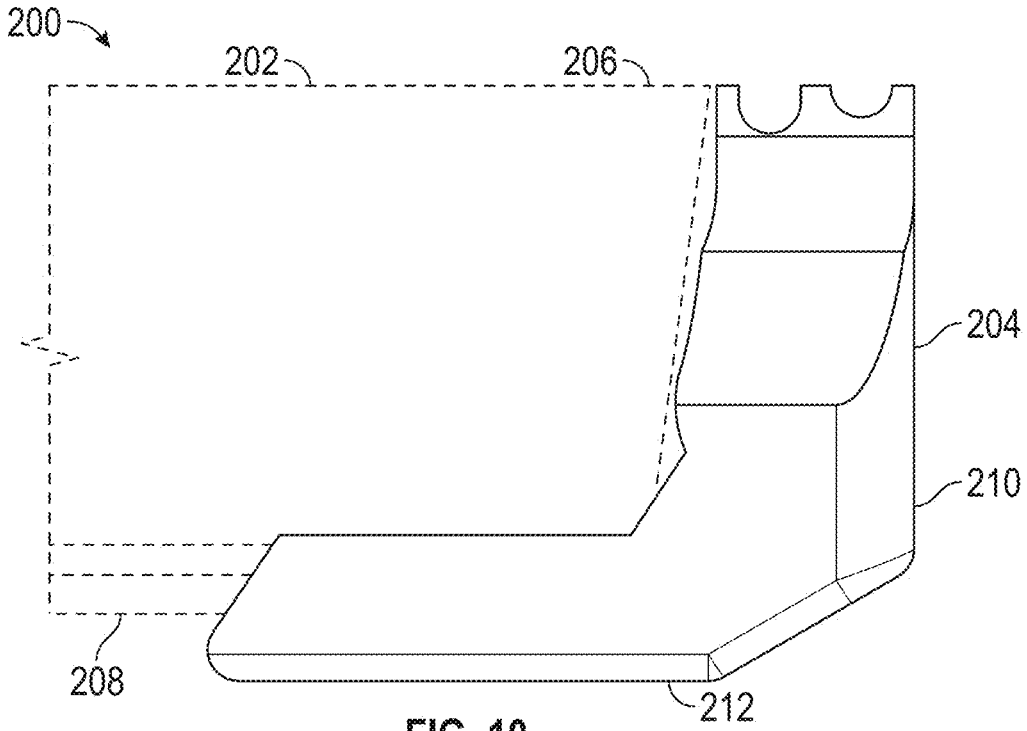
FIG. 10 is a side view of a firearm system, according to another embodiment of the present disclosure.
Figure 11:
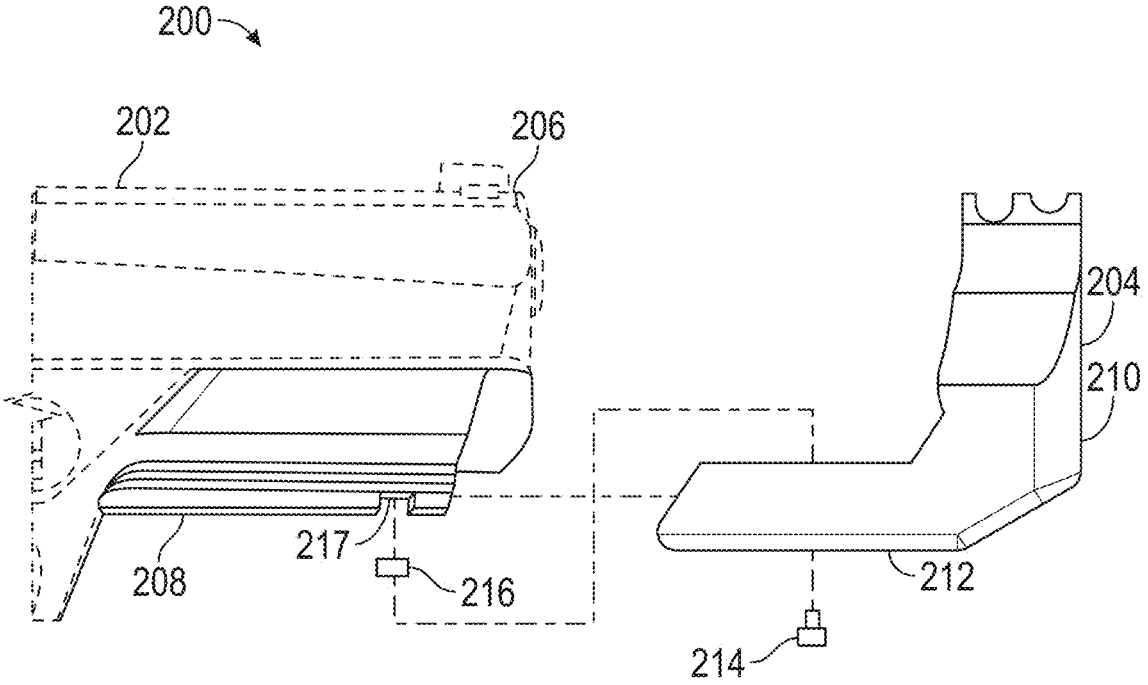
FIG. 11 is an exploded side view of the firearm system of FIG. 10.

FIGS. 10 and 11 illustrate a firearm system 200 according to an embodiment of the present disclosure. More specifically, FIG. 10 is a side view of the firearm system 200, and FIG. 11 is an exploded side view of the firearm system 200, more specifically a firearm 202 and a compensator 204 of the system 200.

The firearm 202 may be, for example, a pistol, more specifically a semi-automatic pistol. In other embodiments, the firearm 202 is a different type of firearm. The firearm 202 includes a muzzle 206 having accessory rails 208 that facilitates mounting the compensator 204.

With continued reference to FIGS. 10 and 11, the compensator 204 generally includes a muzzle portion 210 that is coupled to a mounting portion 212, which may also be referred to a mounting fork. The muzzle portion 210 is configured to be positioned in front on the muzzle 206 of the firearm 202 when the compensator 204 is mounted to the firearm 202. As described in further detail below, the muzzle portion 210 is configured to redirect propellant gasses escaping from the muzzle 206 of the firearm 202 in a manner that reduces recoiling motion of the firearm 202. The mounting portion 212 of the compensator 204 is configured to detachably couple to the firearm 202 via the accessory rails 208, one or more fasteners 214, such as threaded fasteners, and a mounting bracket 216 received in a mounting slot 217 of the accessory rails 208 of the firearm 202.

Figure 12:
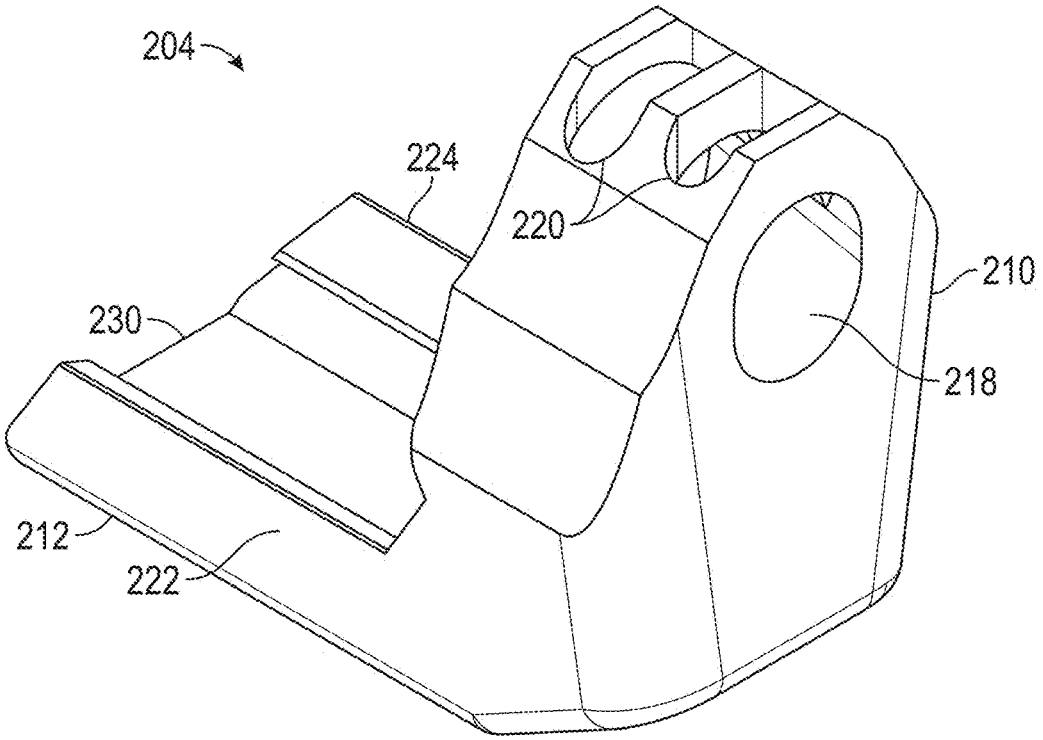
FIG. 12 is a front perspective view of a compensator of the firearm system of FIG. 10.
Figure 13:
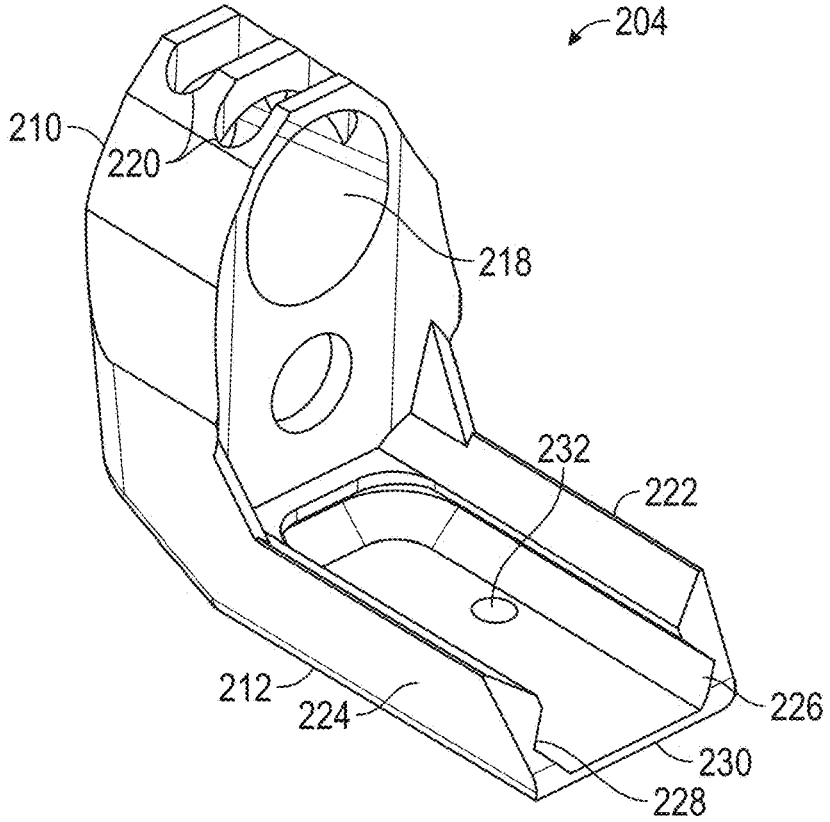
FIG. 13 is a rear perspective view of the compensator of FIG. 12.
Figure 14:
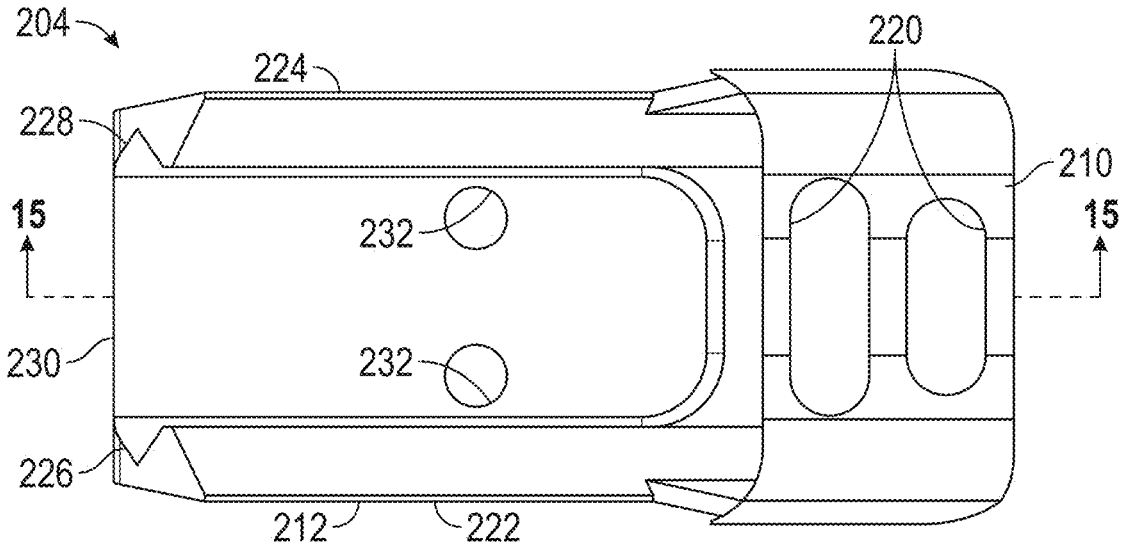
FIG. 14 is a top view of the compensator of FIG. 12.
Figure 15:
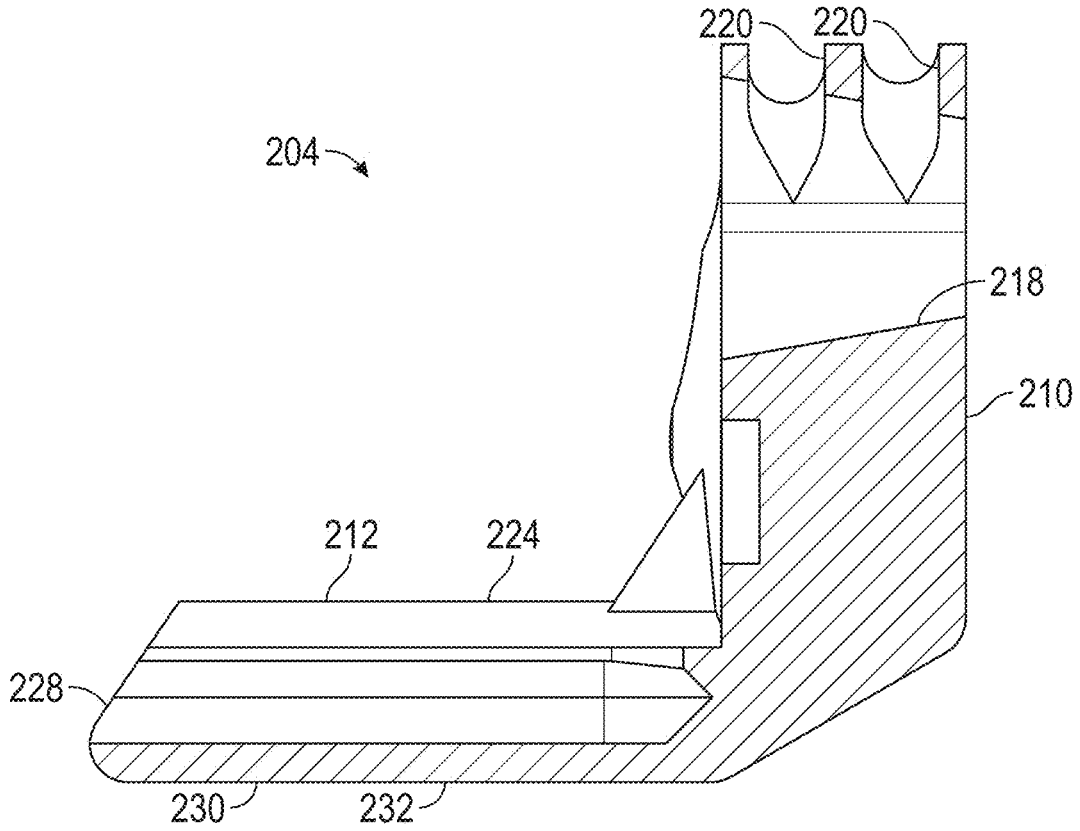
FIG. 15 is a side section view of the compensator along line 15-15 of FIG. 12.

FIGS. 12-15 illustrate the compensator 204 in further detail. More specifically, FIGS. 12 and 13 are perspective views of the compensator 204, FIG. 14 is a top view of the compensator 204, and FIG. 15 is a side section view of the compensator 204 along line 15-15 of FIG. 14. As illustrated, the muzzle portion 210 and the mounting portion 212 of the compensator 204 may be monolithically formed with each other, or constructed from a single piece of material. In other embodiments, the muzzle portion 210 and the mounting portion 212 may be constructed from separate pieces of material and coupled to each other. The compensator 204 may be constructed of various appropriate materials, including metals, plastics, composites, or the like.

The muzzle portion 210 of the compensator 204 includes a bore 218 that illustratively tapers inwardly in the direction of bullet travel or proceeding away from the muzzle 206 of the firearm 202 (shown elsewhere) and the mounting portion 212. In some embodiments, the bore 218 may taper at an angle in a range of about 30 degrees to about 20 degrees, more specifically at an angle in a range of about 20 degrees. The taper of the bore 218 facilitates generating relatively high pressure (i.e., compared to a bore lacking a taper) at one or more gas ports 220 coupled to the bore 218, which extend generally perpendicularly relative to the direction of bullet travel. The tapered bore 218 thereby facilitates relatively high gas exit velocity, which reduces muzzle flip of the firearm 202 as a bullet exits the muzzle 206 and the firearm 202 begins to recoil.

With continued reference to FIGS. 12-15, the mounting portion 212 includes a first arm 222 and a second arm 224 that are configured to receive therebetween and slide along the accessory rails 208 of the firearm 202 (shown elsewhere). Illustratively, the first arm 222 and the second arm 224 include inverted V-shaped internal surfaces 226 and 228, respectively, that are configured to contact V-shaped external surfaces of the accessory rails 208 of the firearm 202. The mounting portion 212 further includes a platform 230 disposed between the first arm 222 and the second arm 224, the platform 230 includes through apertures 232 for receiving the fasteners 214 (shown elsewhere).

Figure 16:
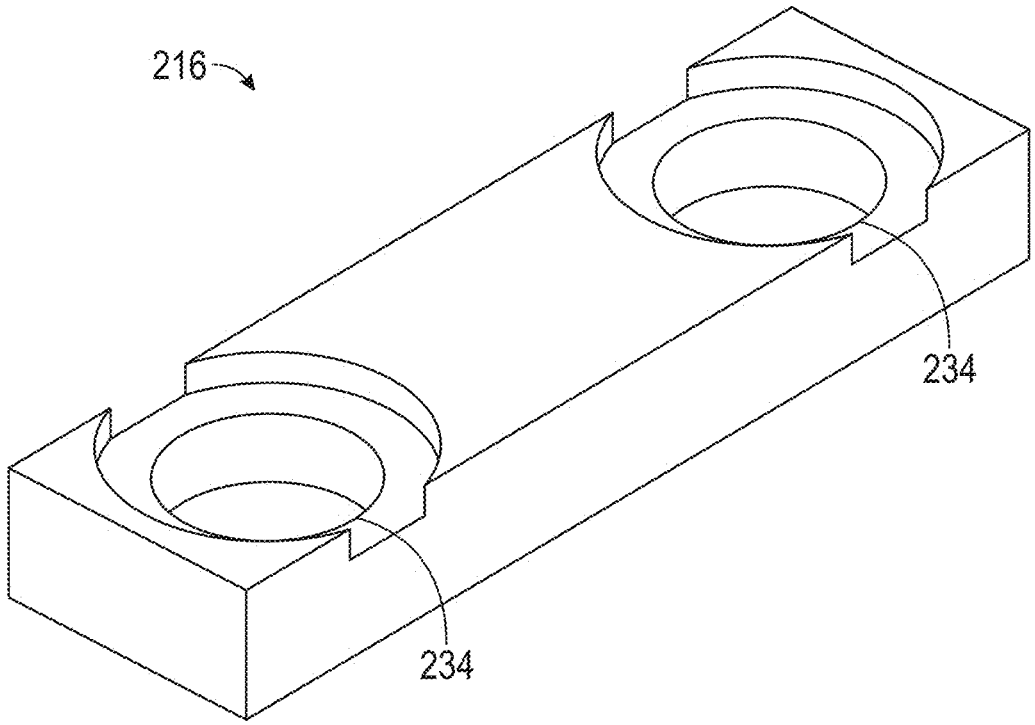
FIG. 16 is a bottom perspective view of a mounting bracket of the firearm system of FIG. 10.
Figure 17:
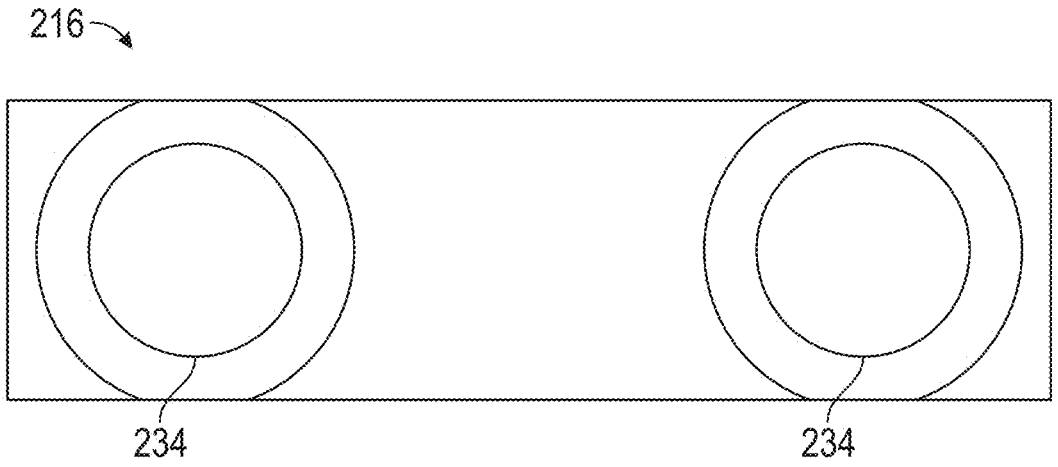
FIG. 17 is a bottom view of the mounting bracket of FIG. 16.
Figure 18:
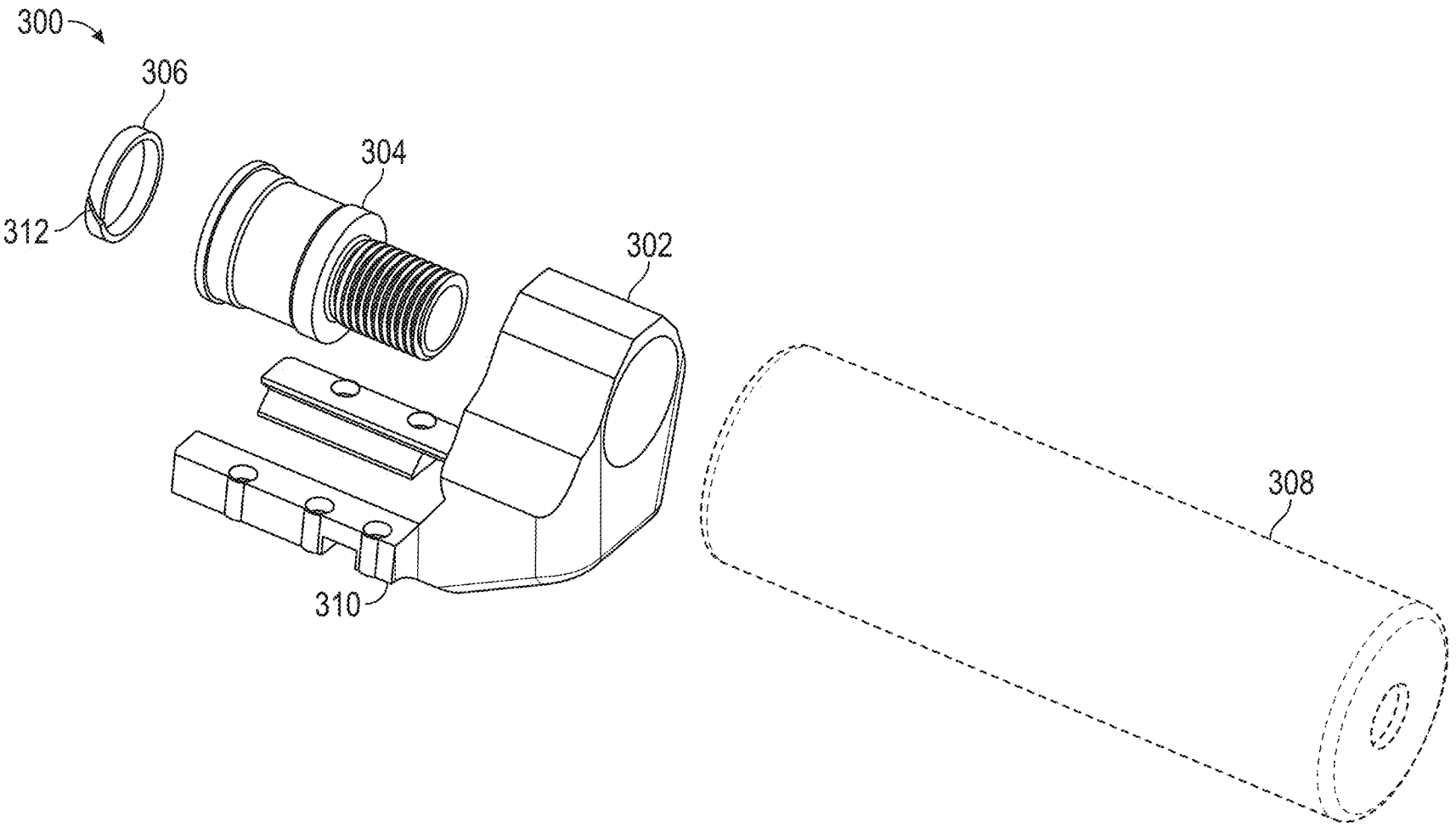
FIG. 18 is an exploded perspective view of a suppressor system, according to another embodiment of the present disclosure.
Figure 19:
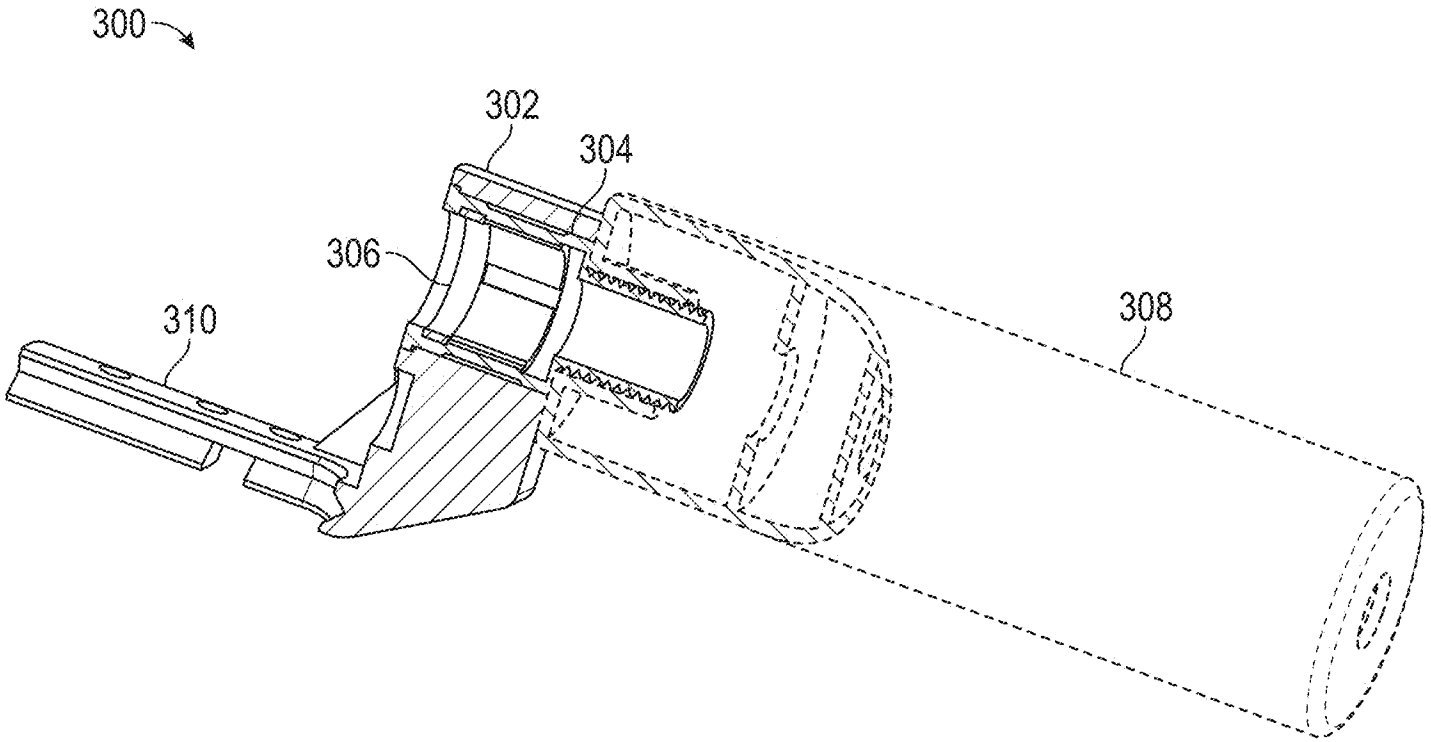
FIG. 19 is a partial perspective sectional view of the suppressor system of FIG. 18.
Figure 20:
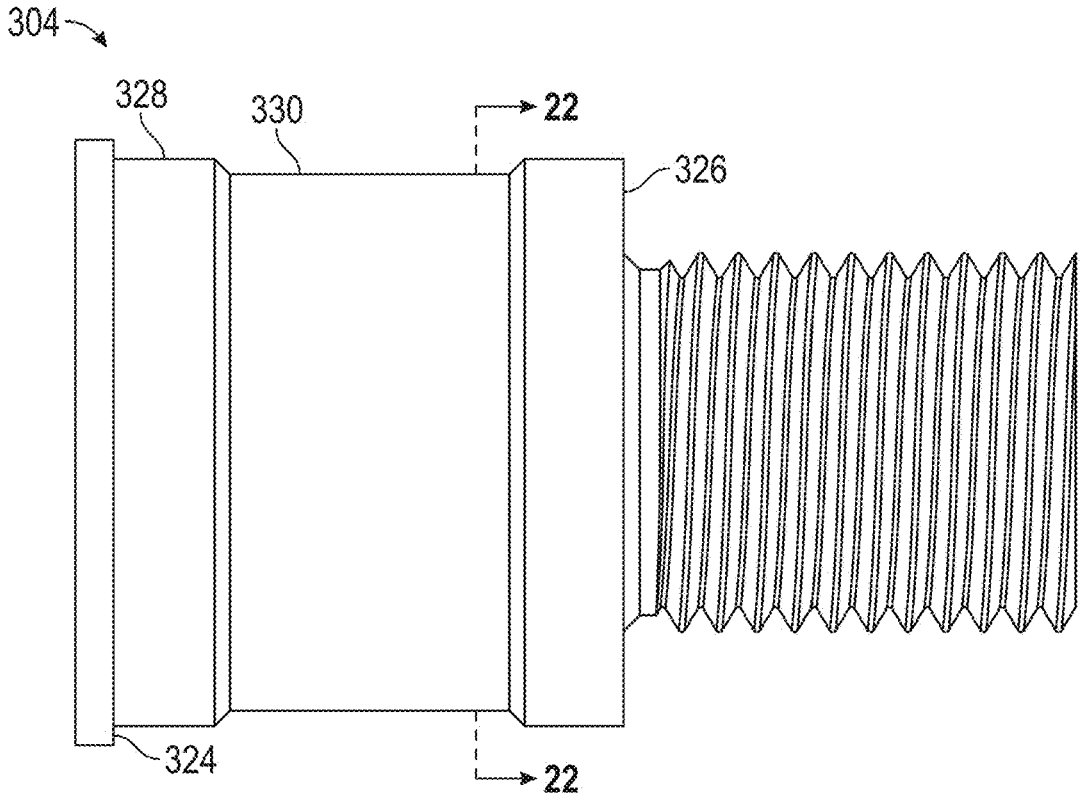
FIG. 20 is a side view of a suppressor adaptor of the suppressor system of FIG. 18.
Figure 21:
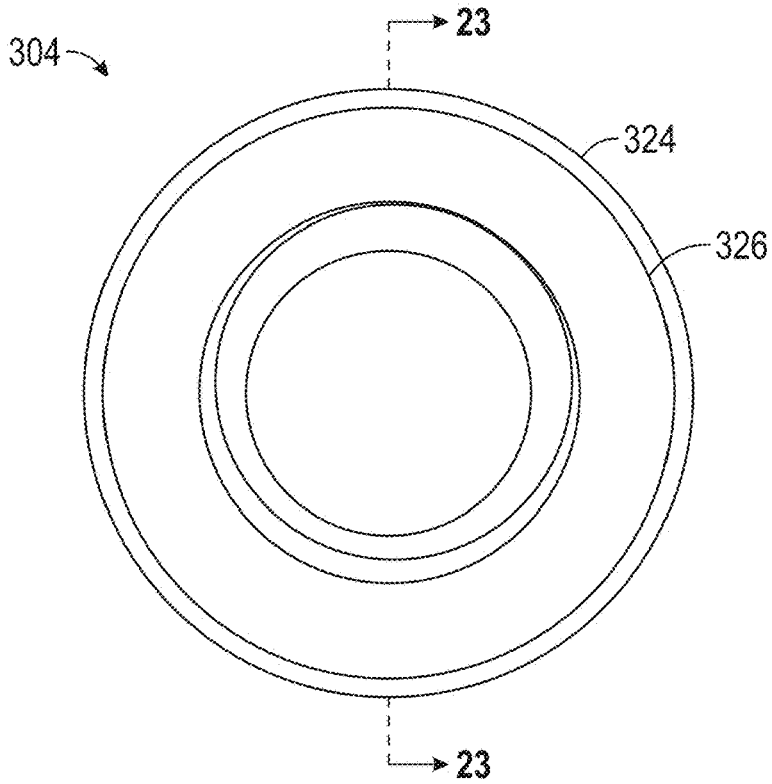
FIG. 21 is a front view of the suppressor adaptor of FIG. 20.

FIGS. 16 and 17 illustrate the mounting bracket 216 in further detail. More specifically, FIG. 16 is a perspective view of the mounting bracket 216 and FIG. 17 is a top view of the mounting bracket 216. The mounting bracket 216 includes apertures 234, more specifically blind apertures, and even more specifically threaded blind apertures, for receiving the fasteners 214 (shown elsewhere) and thereby securing the compensator 204 to the firearm 202 (both shown elsewhere).

FIGS. 18-24 illustrate suppressor system 300 according to an embodiment of the present disclosure. The suppressor system 300 includes a suppressor mount 302, a suppressor adaptor 304, a split ring seal 306, and a suppressor 308. The suppressor mount 302 includes a mounting portion 310 that may be the same or similar to the mounting portion 114 of the compensator 104.

The suppressor adaptor 304 threadably receives the suppressor 308 on its distal end and the split ring seal 306 on its proximal end. The suppressor adaptor 304 is press-fit into the suppressor mount 302 and is positioned such that a commercially available extended barrel (not shown) installed into a firearm (not shown) extends into the proximal end of the suppressor adaptor 304. The split ring seal 306 surrounds the extended barrel and upon firing a gap 312 in the split ring seal 306 closes and seals the propellant gas from escaping the suppressor adaptor 304 and potentially leaking rearward in the direction of the shooter.

Figure 22:
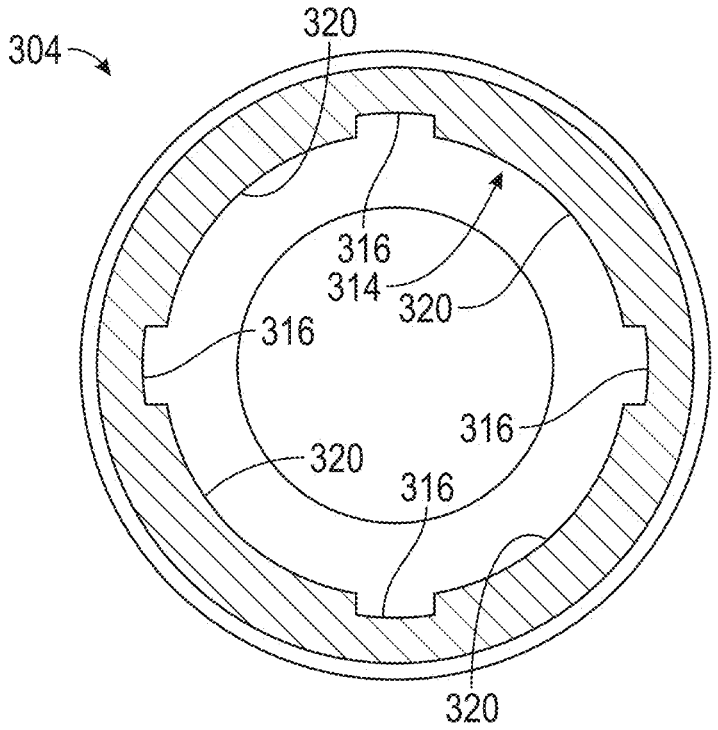
FIG. 22 is a cross section view of the suppressor adaptor along line 22-22 of FIG. 20.
Figure 23:
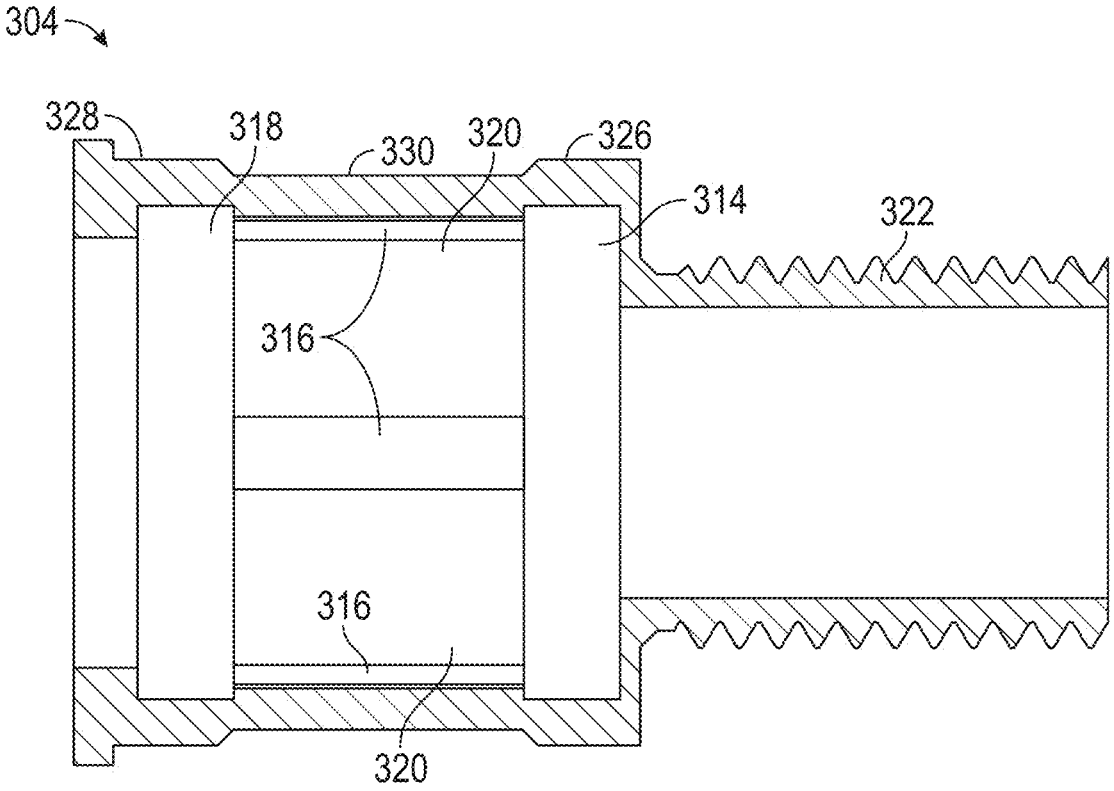
FIG. 23 is a side section view of the suppressor adaptor along line 23-23 of FIG. 21.

Referring specifically to FIGS. 22 and 23, a gas expansion annulus 314 traps a portion of the high-pressure propellant gas and redirects the gas rearward via gas channels 316 that feed the gas into a groove 318 that houses the split ring seal 306 (shown elsewhere). Barrel receiving pads 320 surround the gun barrel and facilitate aligning the suppressor 308 (FIG. 15) with the extended gun barrel (not shown). The suppressor adaptor 304 threadably attaches to an integral alignment tube 322 which aligns the symmetry axis of the suppressor 308 with the firearm barrel to reduce the possibility of a bullet striking the suppressor 308. The suppressor adaptor 304 directs some or all of the high-pressure gas exiting the muzzle through the alignment tube 322 and into the suppressor 308.

Referring again to FIGS. 20-23, a flange 324 mates with the suppressor mount 302 (shown elsewhere) and axially positions the suppressor adaptor 304 within the suppressor mount 302. A forward bearing surface 326 and a rear bearing surface 328 mate with the suppressor mount 302 and together serve to radially align the suppressor adaptor 304 with the suppressor mount 302. During repeat firing of the firearm, impingement of the propellant gases against the interior walls of the suppressor adaptor 304 cause the adaptor 304 to swell due to thermal expansion. A thermal radial expansion relief groove 330 provides clearance between the interior wall of the suppressor mount 302 and the suppressor adaptor 304. The firearm barrel also swells in diameter during repeat firing of the firearm due to thermal expansion. The geometries of the thermal radial expansion relief groove 330 combined with that of the gas channels 316 and the separated barrel pads 320 provide radial compliance between the firearm barrel and the barrel receiving pads 320 and therefore serve to mitigate friction between the heated gun barrel and the receiving pads, inhibiting malfunctioning during repeated firing of the firearm.

Referring specifically to FIG. 22, the relative orientation of the gas channels 316 and the barrel receiving pads 320 is illustrated. The quantity and radial depth of the gas channels 316 and pads 320 may vary based on performance requirements. The gas channels 316 may be purely axial in nature as shown, or they may be of variable width, variable depth, spiral in circumferential form, and/or a greater or lesser number.

Figure 24:
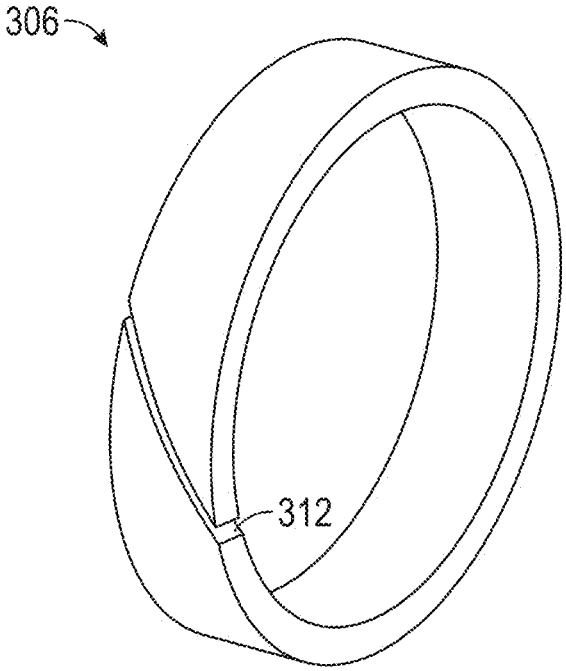
FIG. 24 is a perspective view of a split ring seal of the suppressor system of FIG. 18.

FIG. 24 further illustrates the split ring seal 306. The seal 306 has a normally open gap 312 at an angle to the central axis such that if pressure is applied to one edge of the seal, the gap will close, and the seal will be maintained. When pressure is relieved, the seal 306 relaxes, and the gap returns to is open condition. The gap 312 also allows the seal 306 to compress for installation into or removal from the gas ring seal groove 318 of the suppressor adaptor 304 (shown elsewhere). In some embodiments, a typical silicon O-ring, which remains flexible under high heat and due to its flexibility does not require a gap to install, may be used instead of the split ring seal 306. However, the longevity of a silicon O-ring may be less than that of the split ring seal 306.

Some embodiments of the present disclosure relate to a one-piece frame-mounted pistol compensator that fits on a semi-automatic pistol having an accessory rail and allows the attachment of accessories without sacrificing the fit of the pistol in available commercial holsters. Some embodiments of the present disclosure relate to a suppressor mount that utilizes the same or similar accessory mounting features. Materials used in construction of embodiments according to the present disclosure may include aluminum or carbon fiber composite for the compensator body or the suppressor mount, steel for the suppressor adaptor, and brass, copper, or steel for the split ring seal. Manufacturing processes used to fabricate embodiments according to the present disclosure may utilize standard machine shop tools and practices for metal parts, injection molding for carbon fiber, and/or 3D printing.

Embodiments of present disclosure are not limited by the examples provided in the drawings and specification; for example, the form and/or shape of embodiments according to the present disclosure may change to match various pistol and accessory geometries.

What is claimed is:

1. A compensator configured to couple an accessory to a firearm, the compensator comprising:

a muzzle portion configured to be positioned adjacent a muzzle of the firearm, the muzzle portion configured to redirect propellant gasses escaping from the muzzle of the firearm to reduce recoiling motion of the firearm; and a mounting portion coupled to the muzzle portion, the mounting portion being configured to detachably couple to an accessory rail of the firearm, the mounting portion being configured to detachably receive a fastener to detachably couple to the accessory, and the mounting portion comprising a first arm and a second arm spaced from the first arm to form a gap therebetween, the gap configured to receive a securing bar of the accessory and permit the securing bar to enter a mounting slot of the firearm to secure the accessory and the compensator to the firearm.

2. The compensator of claim 1, wherein the first arm and the second arm are configured to receive therebetween the accessory rail of the firearm.

3. The compensator of claim 1, wherein the muzzle portion and the mounting portion are monolithically formed with each other.

4. The compensator of claim 1, wherein the muzzle portion comprises a bore.

5. The compensator of claim 4, wherein the bore is a tapering bore.

6. The compensator of claim 5, wherein the bore tapers inwardly proceeding away from the mounting portion.

7. The compensator of claim 4, wherein the muzzle portion comprises a gas port coupled to the bore.

8. The compensator of claim 2, wherein the first arm and the second arm both include through apertures configured to receive fasteners for coupling the accessory to the compensator.

9. The compensator of claim 1, wherein the mounting portion further includes a slot configured to receive the securing bar of the accessory.

10. A compensator system configured to couple to a firearm, the compensator system comprising:

a compensator, comprising:

a muzzle portion configured to be positioned adjacent a muzzle of the firearm;

a mounting portion coupled to the muzzle portion, the mounting portion being configured to detachably couple to an accessory rail of the firearm, and the mounting portion including a through aperture;

a mounting bracket configured to be received in a mounting slot of the firearm, the mounting bracket including an aperture; and a fastener received in the through aperture of the mounting portion and the aperture of the mounting bracket to secure the compensator to the firearm.

11. The compensator system of claim 10, wherein the mounting portion further comprises a first arm and a second arm that are configured to receive therebetween the accessory rail of the firearm.

12. The compensator system of claim 10, wherein the muzzle portion and the mounting portion are monolithically formed with each other.

13. The compensator system of claim 10, wherein the muzzle portion comprises a bore.

14. The compensator system of claim 10, wherein the fastener is a threaded fastener and the aperture of the mounting bracket is a threaded aperture.

15. The compensator system of claim 10, wherein the aperture of the mounting bracket is a blind aperture.

16. A firearm system comprising:

a firearm comprising a muzzle having an accessory rail and a mounting slot;

an accessory having a securing bar;

a fastener;

a compensator comprising:

a muzzle portion configured to be positioned adjacent the muzzle of the firearm, the muzzle portion configured to redirect propellant gasses escaping from the muzzle of the firearm to reduce recoiling motion of the firearm; and a mounting portion coupled to the muzzle portion, the mounting portion being configured to detachably couple to the accessory rail of the firearm, the mounting portion being configured to detachably receive the fastener to detachably couple to the accessory, and the mounting portion comprising a first arm and a second arm spaced from the first arm to form a gap therebetween, the gap configured to receive the securing bar of the accessory and permit the securing bar to enter the mounting slot of the firearm to secure the accessory and the compensator to the firearm.

17. The firearm system of claim 16, wherein the first arm and the second arm are configured to receive therebetween the accessory rail of the firearm.

18. The firearm system of claim 16, wherein the muzzle portion and the mounting portion are monolithically formed with each other.

19. The firearm system of claim 16, wherein the muzzle portion comprises a bore.

20. The firearm system of claim 19, wherein the muzzle portion comprises a gas port coupled to the bore.

* * * * *